US007237285B2

(12) United States Patent
Brewin et al.

(10) Patent No.: US 7,237,285 B2
(45) Date of Patent: Jul. 3, 2007

(54) ADJUSTABLE BED RAIL

(75) Inventors: Joseph F. Brewin, Franklin, MA (US); Bryan R. Hotaling, Acton, MA (US); Lawrence J. Salvo, Stow, MA (US); Tyrone Young, Johnston, RI (US)

(73) Assignee: The First Years Inc., Avon, MA (US)

( * ) Notice: Subject to any disclaimer, the term of this patent is extended or adjusted under 35 U.S.C. 154(b) by 0 days.

(21) Appl. No.: 10/459,130

(22) Filed: Jun. 10, 2003

(65) Prior Publication Data

US 2004/0250347 A1 Dec. 16, 2004

(51) Int. Cl.
*A47C 21/08* (2006.01)

(52) U.S. Cl. ..... 5/426; 5/430

(58) Field of Classification Search ..... 5/424–430
See application file for complete search history.

(56) References Cited

U.S. PATENT DOCUMENTS

| | | | | | |
|---|---|---|---|---|---|
| 2,195,955 | A | * | 4/1940 | Hillenbrand | 5/430 |
| 2,722,693 | A | | 11/1955 | Wolf | |
| 2,751,608 | A | | 6/1956 | Lucas | |
| 3,021,534 | A | * | 2/1962 | Hausted | 5/430 |
| 3,097,370 | A | | 7/1963 | Murcott | |
| 3,289,223 | A | | 12/1966 | Oja et al. | |
| 3,402,409 | A | | 9/1968 | Kain | |
| 3,624,847 | A | | 12/1971 | Murcott et al. | |
| 3,930,273 | A | * | 1/1976 | Stern | 5/430 |
| 4,596,484 | A | | 6/1986 | Nakatani | |
| 4,676,687 | A | * | 6/1987 | Koffler | 5/430 |
| 4,724,559 | A | | 2/1988 | Bly et al. | |
| 4,833,743 | A | | 5/1989 | Howell et al. | |
| 5,038,430 | A | | 8/1991 | Bly | |
| 5,070,665 | A | | 12/1991 | Marrin et al. | |
| 5,384,927 | A | * | 1/1995 | Mardero et al. | 5/662 |
| 5,596,776 | A | | 1/1997 | Huang | |
| 5,640,726 | A | | 6/1997 | Fichner-Rathus | |
| 5,671,490 | A | * | 9/1997 | Wu | 5/426 |
| 5,784,732 | A | | 7/1998 | Vail | |
| 5,967,214 | A | | 10/1999 | Beretta | |
| 6,134,731 | A | * | 10/2000 | Thom et al. | 5/662 |
| 6,243,894 | B1 | | 6/2001 | Kosumsuppamala et al. | |
| 6,453,490 | B1 | | 9/2002 | Cardinale | |
| 6,487,735 | B1 | * | 12/2002 | Jacques et al. | 5/424 |
| 2003/0024047 | A1 | | 2/2003 | Wu | |
| 2004/0040089 | A1 | * | 3/2004 | Flannery et al. | 5/425 |

FOREIGN PATENT DOCUMENTS

| | | | |
|---|---|---|---|
| GB | 2225716 | A * | 6/1990 |

* cited by examiner

*Primary Examiner*—Michael Safavi
(74) *Attorney, Agent, or Firm*—Michael Best & Friedrich LLP

(57) ABSTRACT

A safety bed rail for preventing an individual from falling out of a bed including a frame of sufficient width to span a width of the bed and having left and right portions adjustably connected by a releasable latch defining a plurality of discrete frame widths corresponding to standard bed sizes. A bed rail panel is attached to one side of the frame and extends up from the frame a sufficient height to extend above a mattress placed over the frame. The frame includes side flanges that engage sides of one of the mattress and an underlying mattress support of similar width to the mattress with frame disposed between the mattress and the support. The flanges are widthwise adjustable to adjust the width of the frame over a limited distance with the latch connecting the left and right frame portions in a selected position.

19 Claims, 13 Drawing Sheets

ADJUSTABLE BED RAIL

TECHNICAL FIELD

This invention relates to safety bed rail devices for preventing an individual from falling out of an adult bed.

BACKGROUND

Removable bed rails may be attached to a bed for preventing children or others from falling to the floor and other hazards. Bed rails generally include a vertical surface or bar extending above and disposed immediately adjacent a side of the bed. To facilitate continued ingress and egress, bed rails may swing out of the way and/or be easily removable. Some children have been harmed by becoming lodged in spaces between mattresses and bed rails, such as can form when the bed rail fails to remain securely attached to the side of the bed, or when the bed rail is not properly positioned. This separation can pose a safety hazard to children under some circumstances.

SUMMARY

According to one aspect of the invention, a safety bed rail for preventing an individual from falling out of bed includes a frame of sufficient width to span a width of the bed and has left and right portions adjustably connected by a releasable latch. The latch defines a plurality of discrete frame widths corresponding to standard bed sizes. A bed rail panel attaches to one side of the frame and extends up from the frame a sufficient height to extend above a mattress placed over the frame. The frame includes side flanges that engage sides of one of the mattress and an underlying mattress support of similar width to the mattress with the frame disposed between the mattress and the support. The flanges are widthwise adjustable to adjust the width of the frame over a limited distance with the latch connecting the left and right frame portions in a selected position.

According to another aspect of the invention, a safety bed rail for preventing an individual from falling out of a bed includes a frame of sufficient width to span a width of the bed and has left and right portions adjustably connected by an adjustable clamp. The adjustable clamp has at least one actuating lever extending therefrom. A bed rail panel attached to one side of the frame and extends up from the frame a sufficient height to extend above a mattress placed over the frame. The frame includes side flanges that engage sides of one of the mattress and an underlying mattress support of similar width to the mattress with frame disposed between the mattress and the support.

According to still another aspect of the invention, a safety rail for preventing an individual from falling out of a bed includes elongated transverse members having first and second ends, the transverse members including two telescoping members for adjusting the length thereof and adapted for placement in the space between a mattress and a foundation of the bed. An adjustment lever is pivotally attached to one of the first and second ends of the transverse members and positioning the lever upward enables relative movement of the telescoping members of the transverse members and positioning the lever downward in a substantially horizontal position locks the relative movement of the telescoping members of the transverse members. The upward position of the lever at least partially separates a portion of the mattress from a portion of the mattress foundation.

In various embodiment according to the aforementioned aspects of the invention, the bed rail is pivotally attached to one side of the frame and can be locatable in an upright deployed position and a lowered undeployed position. In one embodiment, a bed rail panel is attached at both ends of the widthwise direction of the frame, in other embodiments, only one bed rail panel is included. In one embodiment, side flanges are rotatably coupled to the frame and rotation of the flange adjusts the width of the frame over a limited distance.

In one embodiment, the bed rail panel is formed from a tubular frame and supports a fabric covering. In other embodiments, the tubular frame includes substantially clear panels sewn into a fabric mesh attached to the fabric covering along an upper portion of the bed rail panel. In some embodiments, the bed rail panel includes a sewn in perforated masonite panel attached along a lower portion of the bed rail panel.

The details of one or more embodiments of the invention are set forth in the accompanying drawings and the description below. Other features, objects, and advantages of the invention will be apparent from the description and drawings, and from the claims.

DESCRIPTION OF DRAWINGS

Throughout the discussion of the illustrative embodiments, like reference symbols in the various drawings generally indicate like elements.

DETAILED DESCRIPTION

Figure 1:
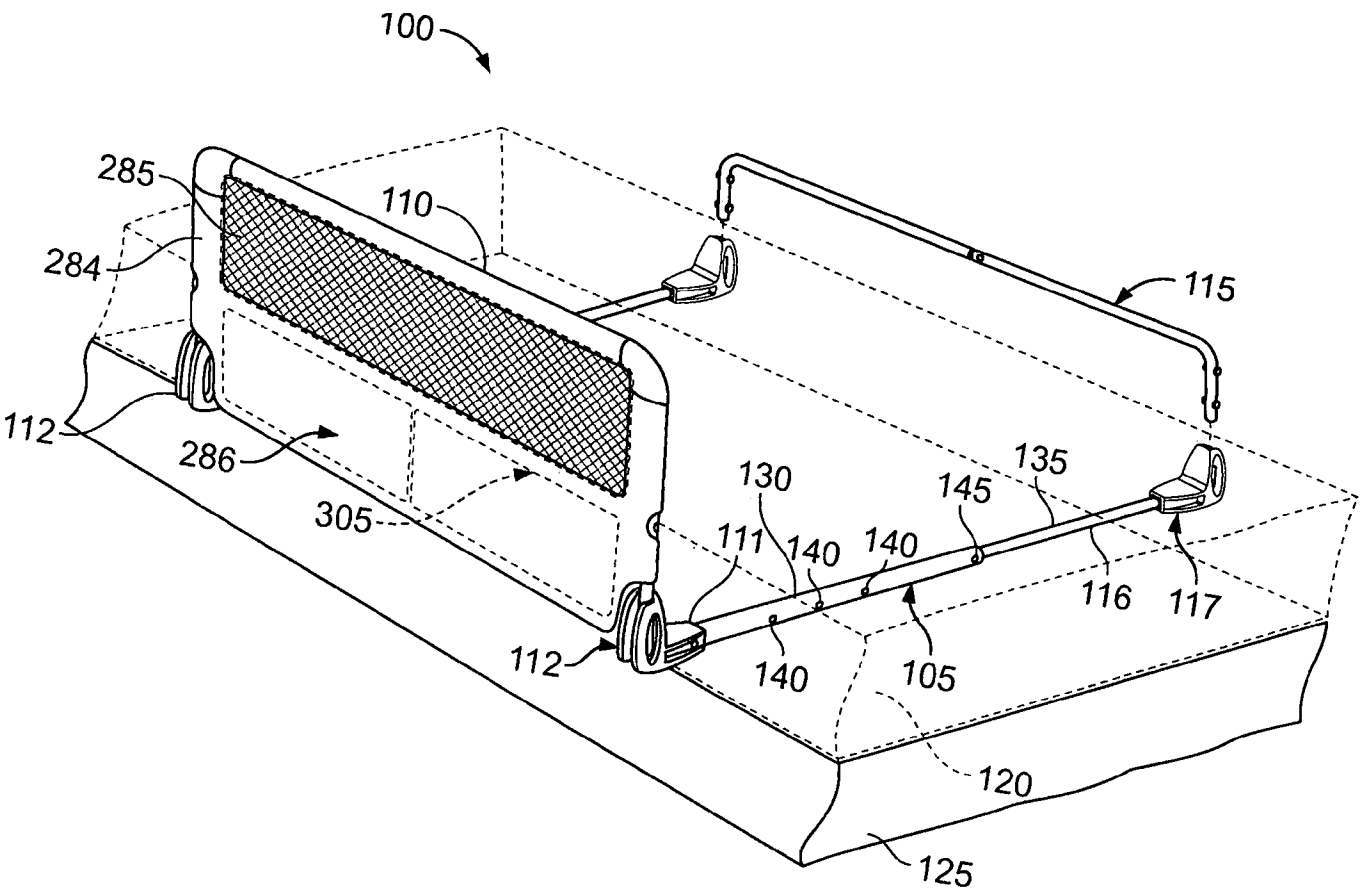
FIG. 1 is a perspective view of a bed rail according to one aspect of the invention, positioned on a bed with the mattress shown in phantom.
Figure 2:
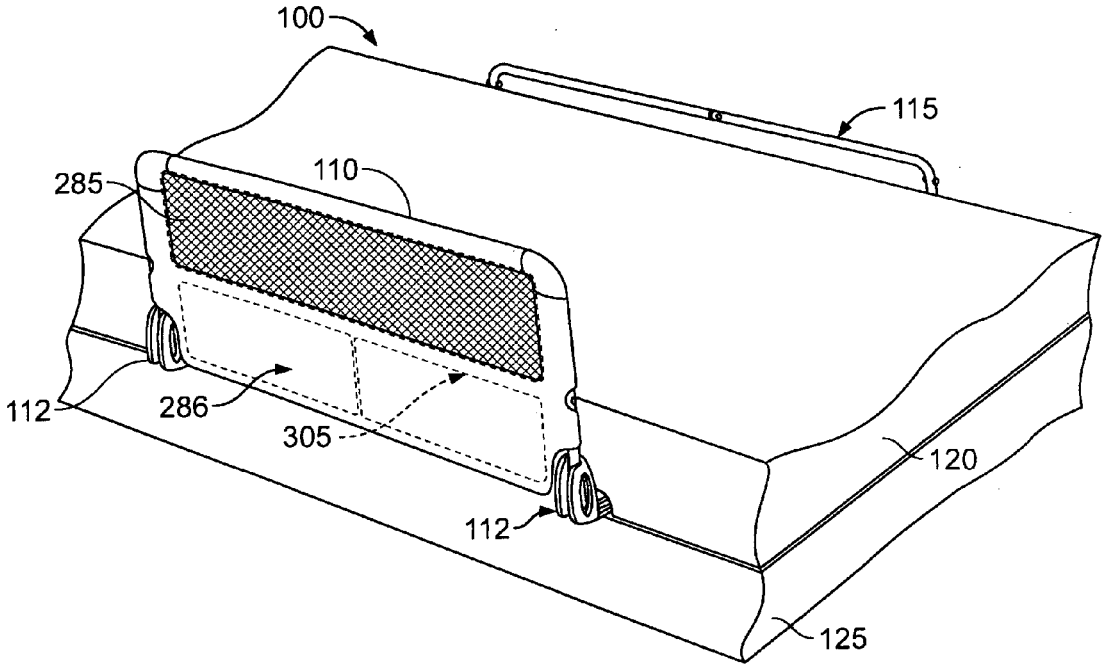
FIG. 2 is a perspective view of the bed rail of FIG. 1 installed on a bed.

Referring first to FIGS. 1 and 2, a bed rail 100 includes two transverse members 105 and a side panel 110 attached to the first ends 111 of the transverse members 105 with a first set of support brackets 112. In one embodiment, the side panel 110 is pivotally attached to the transverse member 105 at the support brackets 112. A retention member 115 is attached to second ends 116 of transverse members 105 with a second set of support brackets 117. The transverse members 105 are inserted between a mattress 120 (shown in phantom lines in FIG. 1 and solid lines in FIG. 2) and an underlying mattress support or foundation 125, such as a box spring. In one embodiment, the transverse members 105 are formed from tubular steel.

The side panel 110 extends longitudinally a sufficient length along the mattress 120 to reduce or prevent the possibility of an individual from inadvertently falling off the bed. The side panel 110 extends in a vertical direction such that the panel 110 extends above the height of the mattress 120 when the side panel 110 is in a deployed and upright position as shown in FIG. 2.

In one embodiment, the transverse members 105 include a first member 130 telescopically engaging a second member 135 to permit large adjustment of the length of the transverse members 105. Accordingly, the length of transverse members 105 may be adjusted to accommodate and securely attach to mattresses 120 and foundations 125 of varying sizes.

In one embodiment, the first member 130 of transverse members 105 includes a plurality of holes 140 sized to receive a spring pin 145, such as a Valco spring pin, disposed within the second member 135. The spring pin 145 is biased to engage one of the holes 140 when the spring pin 145 is positioned coincidentally therewith. The plurality of holes 140 are located along the first member 130 such that when the spring pin 145 is received from the second member 135 the overall length of transverse members 105 substantially corresponds to the width of the commonly available sizes of mattresses 120 and foundations 125, including for example, king, queen, full and twin.

Figure 3:
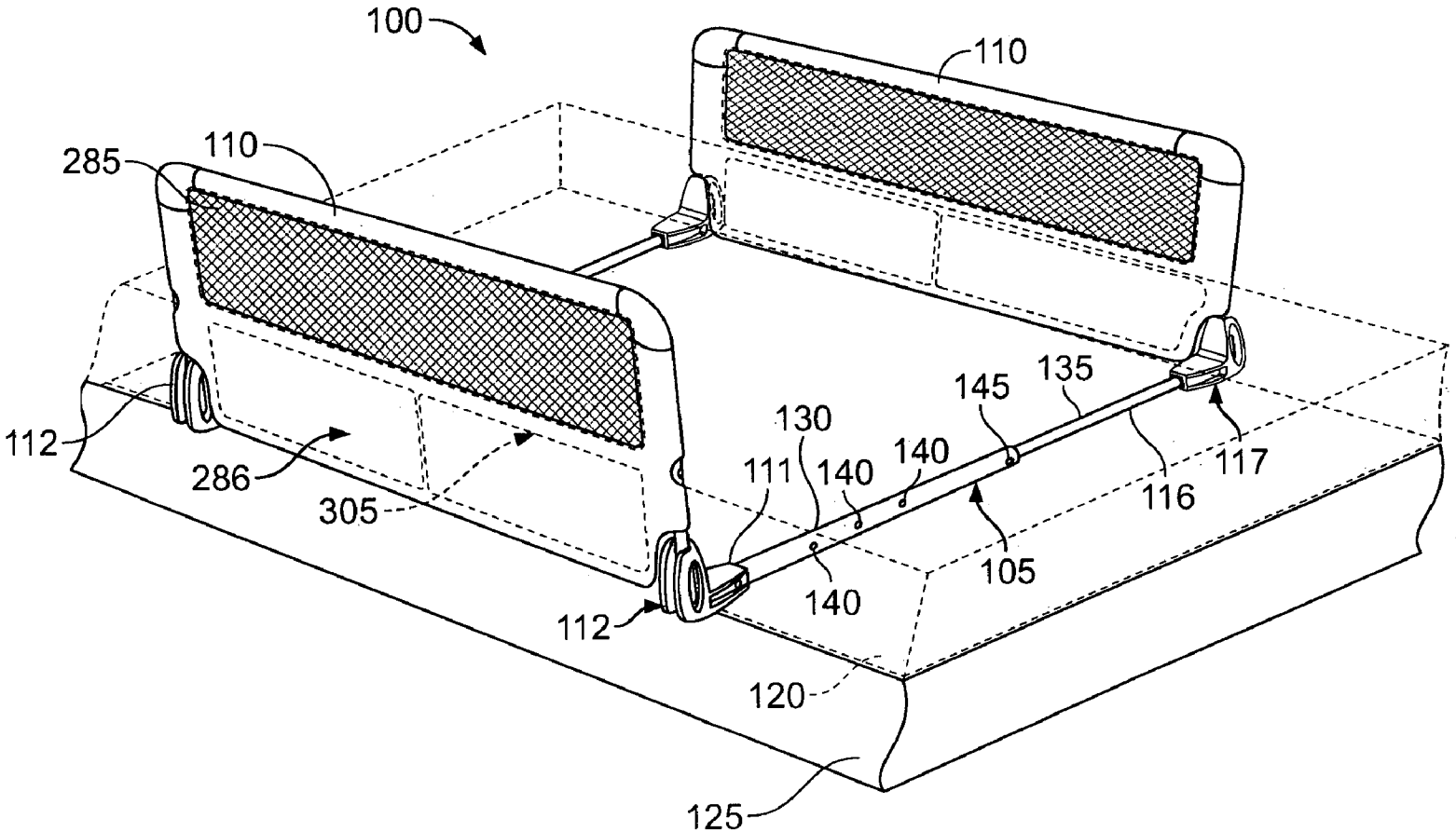
FIG. 3 is a perspective view of a bed rail according to another aspect of the invention having two rail panels.

FIG. 3 shows a second embodiment of the a bed rail 100 including a second side rail panel 110 attached to the second ends 116 of the transverse members 105 in place of the retention member 115 at the second set of support brackets 117. In one embodiment, the second side rail panel 110 is pivotally attached at the support brackets 117. The second side rail panel 110 also extends longitudinally a sufficient length to reduce or prevent the possibility of an individual from inadvertently falling off the bed. The second side panel 110 extends in a vertical direction such that the panel 110 extends above the height of the mattress 120 when the side panel 110 is in a deployed and upright position.

Figure 4A:
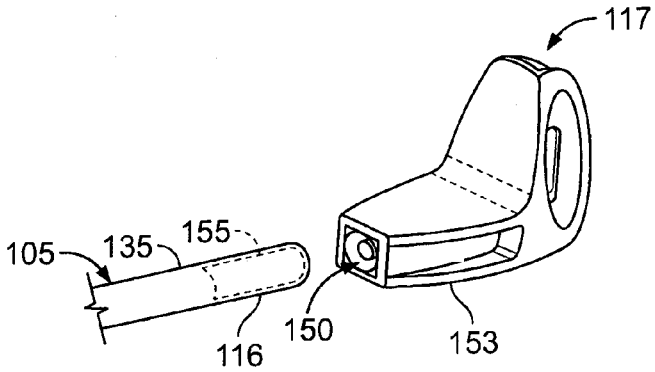
FIG. 4A is a detailed perspective view of an end bracket of the bed rail of FIGS. 1–3 positioned for attachment to a transverse member.

Referring now to FIGS. 4A–4D, the second set of support brackets 117 engage the second end 116 of the transverse member 105. Note, that in an alternative embodiment, the first set of support brackets 112 engage the first end 111 of the transverse member 105 in the manner described below. After the large length adjustment of the transverse members 105 is set and locked with Valco pin 145, for a particular bed size, a fine length adjustment is established as shown in the embodiment of FIG. 4A. A threaded insert 150 is disposed within a horizontal prong 153 of the second set of support brackets 117 for engaging a threaded sleeve 155 affixed within the inner diameter of the second end 116 of the transverse members 105. In one embodiment, the threaded insert 150 is molded to the horizontal prong 153. In some embodiments, the threaded sleeve 155 may be welded or press fit within the inner diameter of the second end 116 of the transverse member 105.

Figure 4B:
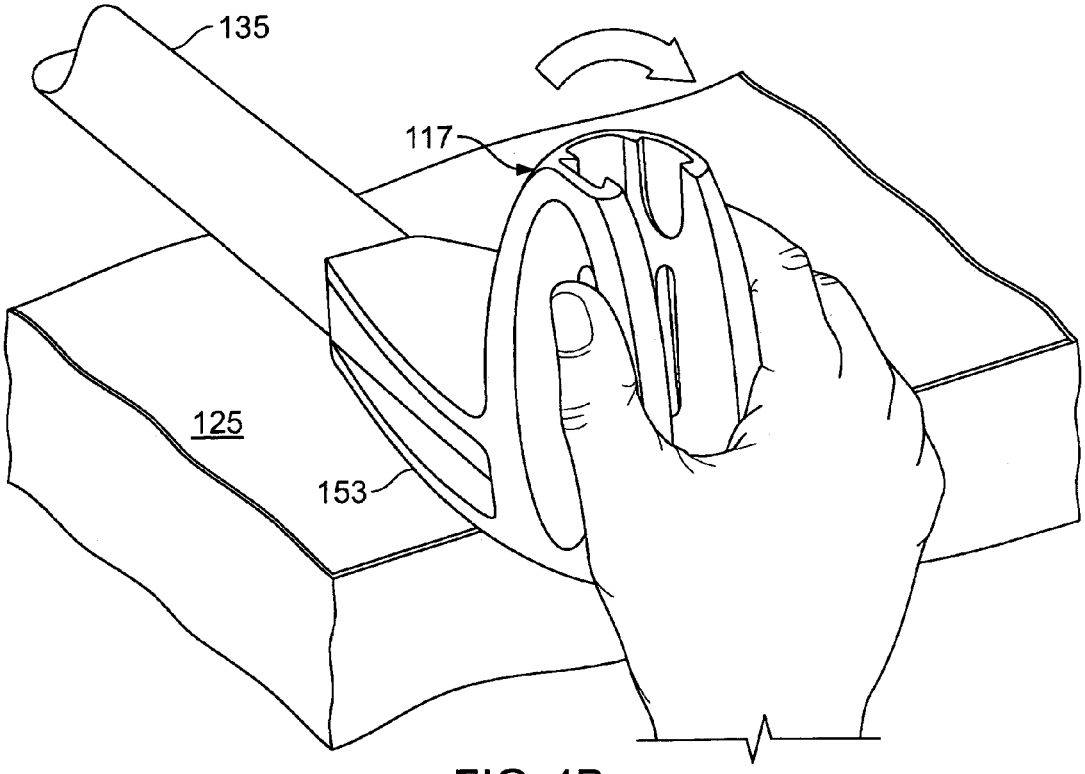
FIG. 4B is a detailed perspective view of an end bracket being rotated at one end of the transverse member for fine adjustment of the length of the transverse member.

Referring to FIG. 4B, the rotation of the support bracket 117 in a first direction threads the second member 135 of the transverse member 105 into the support bracket 117, thereby shortening the exposed length of the transverse members 105. Rotation of the support bracket 117 in a second direction threads the second member 135 of the transverse member 105 out of the support bracket 117, thereby lengthening the exposed distance of the transverse member 105. In so doing, fine adjustments to the exposed length of the transverse member 105 are effected to accommodate variations in standard mattress 120 and foundation 125 sizes, thereby ensuring a proper and secure installation of the bed rail unit 100. Alternatively, the transverse member 105 may be rotated and the support bracket 117 held stationary to effect fine adjustment of the transverse member 105.

Figure 4C:
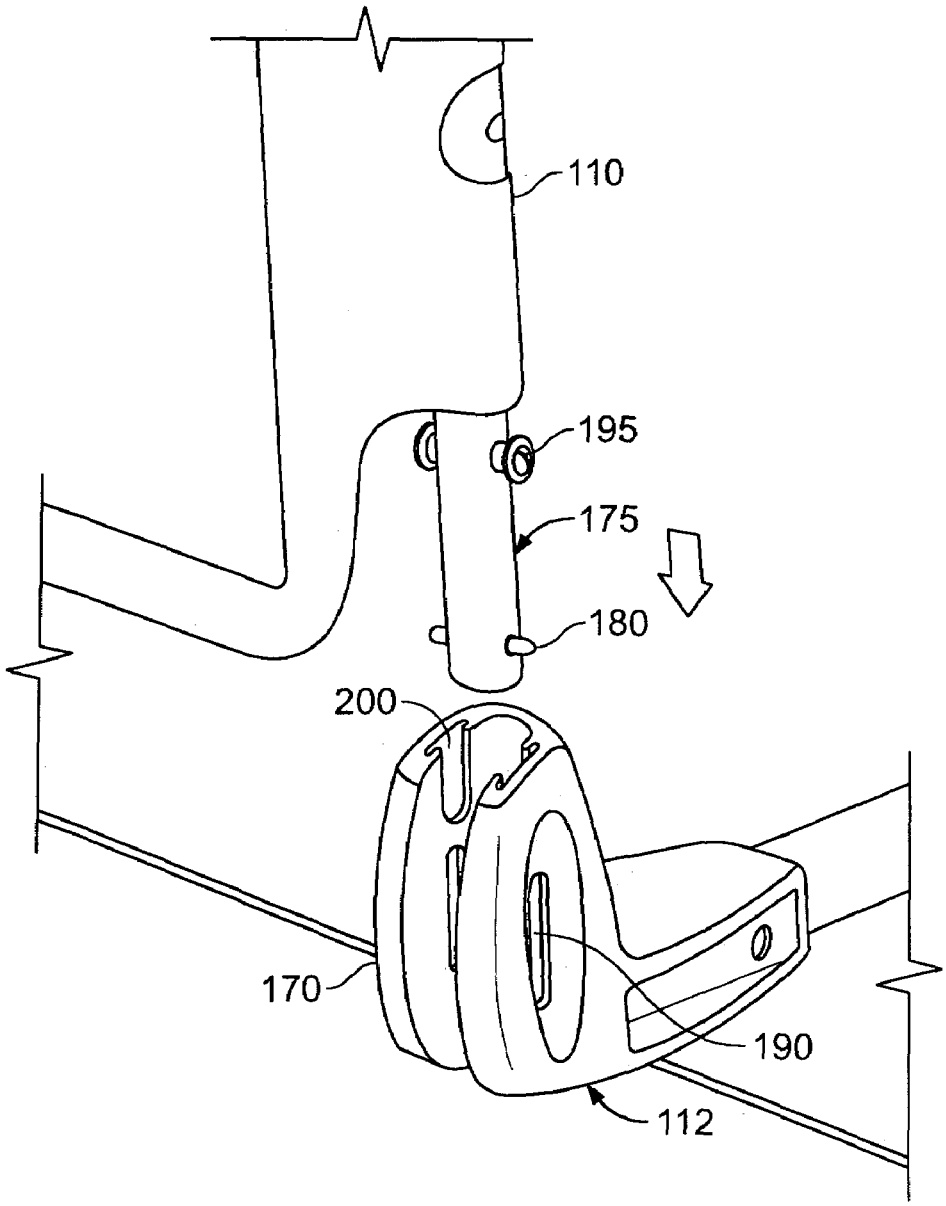
FIG. 4C is a detailed perspective view of one end of a bed rail panel according to a first embodiment engaging an end bracket.

Referring now to FIG. 4C, the side panel 110 is removably inserted into the first set of support brackets 112. In one embodiment, the vertical prongs 170 of the support brackets 112 slideably receive the engagement ends 175 of the side panel 110. Side panel Valco pins 180 are positioned at a lower portion of the engagement ends 175 and are sized and positioned to be received into a slot 190 in the vertical prong 170 of the support bracket 112. A pair of grommets 195 are attached to an upper portion of the engagement ends 175 and are sized and positioned to be received in a corresponding pair of notches 200 disposed in the vertical prong 170 of the support bracket 112.

To insert the side panel 110 into the support brackets 112, the Valco pins 180 are compressed to permit passage of the engagement end 175 into the vertical prong 170 of the support bracket 112. When the Valco pins 180 are positioned opposite the slot 190, the pins 180 are released to protrude through the slot 190, thereby attaching the engagement end 175 to the support bracket 112. Continued downward movement of the engagement end 175 causes the grommets 195 to engage the notches 200 of the support bracket 112. The relative diameters of the grommets 195 and the notches 200 are sized to establish a pressure fit therebetween to effect locking of the side panel 110 is a vertical, deployed position.

Figure 4D:
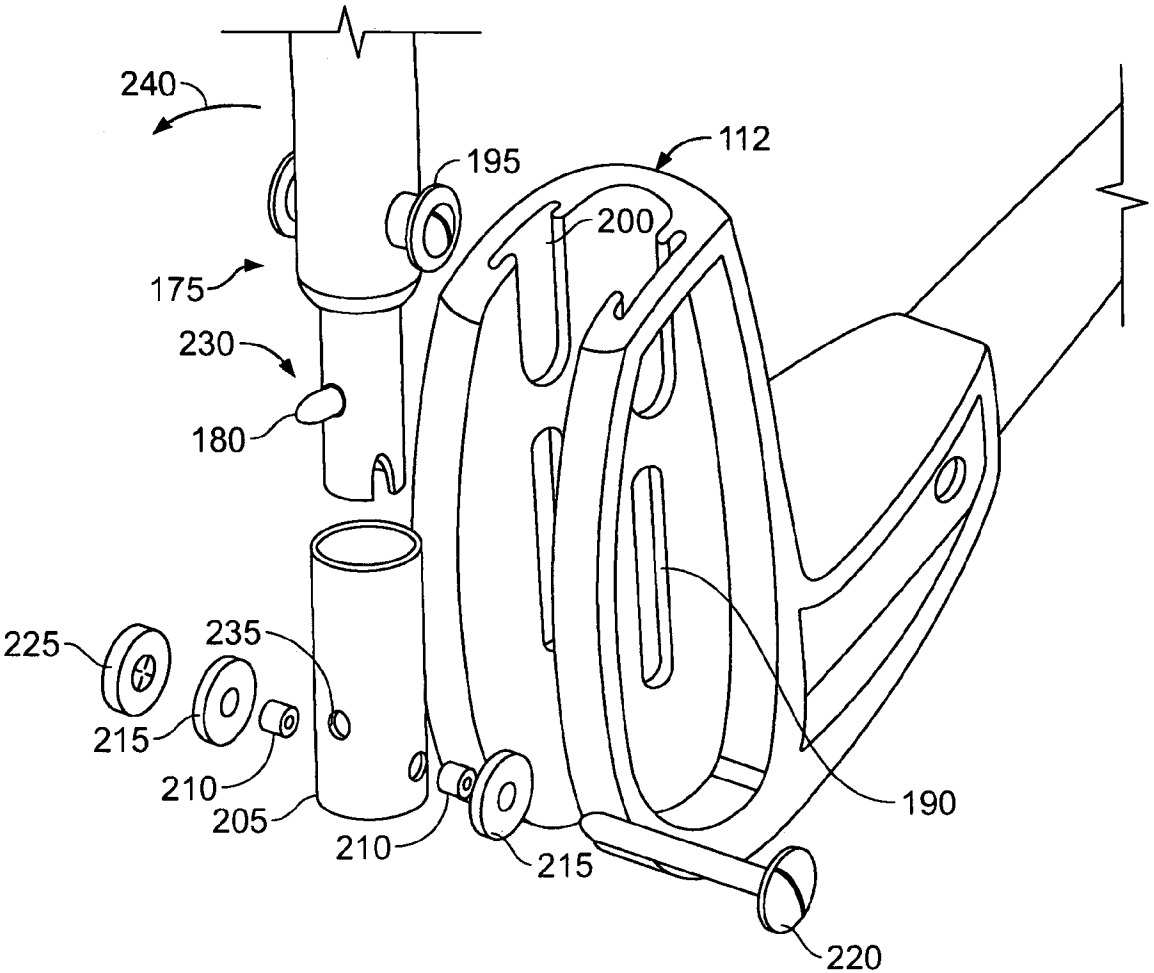
FIG. 4D is a detailed perspective view of one end of a bed rail panel according to a second embodiment engaging and end bracket.

In an alternative embodiment, as shown in FIG. 4D, a collar 205 is pivotally attached to the support bracket 112 with a spacer 210 and a washer 215 affixed to both sides of collar 205 by a pin 220 and a fastener 225 extending through the slot 190. The spacer 210 follows the slot 190 and the collar 205 is pivotally attached to support bracket 112 at the pin 220. The engagement end 175 includes a taper 230 and a Valco pin 180 for cooperating with the collar hole 235 when the engagement end 175 is inserted into the collar 200. Grommets 195 are attached on either side of the engagement end 175 for engagement with the notches 200 of the support bracket 112. To insert the side panel 110 into the support brackets 112, the Valco pin 180 is compressed while sliding the taper 230 into the collar 205 until the pin 180 is coincident with and protrudes from the collar hole 135 thereby releasably attaching the engagement end 175 to the collar 205.

In operation, the grommets 195 slideably engage grooves 200 formed above the slots 190 of the support brackets 112 to lock the side panel 110 in the deployed and upright position. The relative diameters of the grommets 195 and the notches 200 are sized to establish a pressure fit therebetween. When sufficient upward vertical pressure is applied to the side panel 110, the grommets 195 disengage from the notches 200 and the side panel 110 is moved upward with engagement end 175 slideably retained along the slot 190 with the spacers 210 and washers 215. When the engagement end 175 is sufficiently raised such that the grommets 195 are clear of the notches 200 in the support brackets 112, the side panel 110 may be rotated in the direction of arrow 240 toward a downward, undeployed position.

Figure 5A:
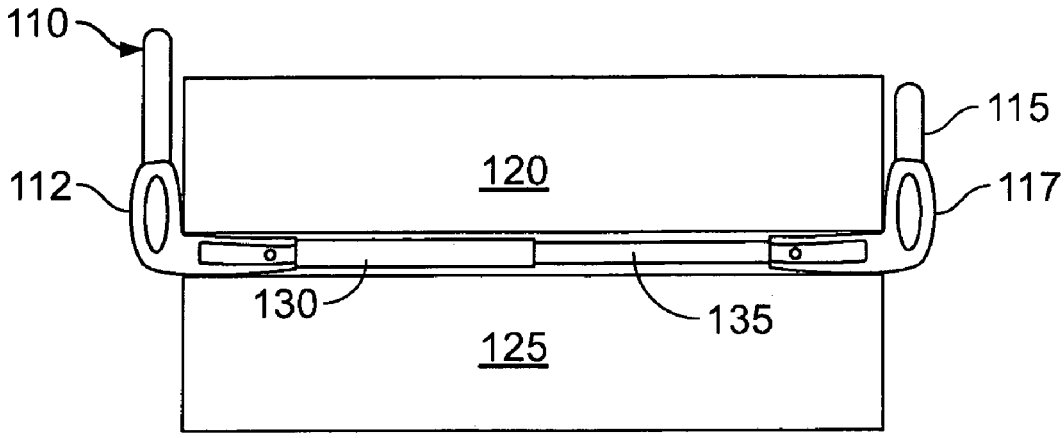
FIGS. 5A and 5B are side views of the bed rail of FIG. 1 in upright and lower positions, respectively.
Figure 5B:
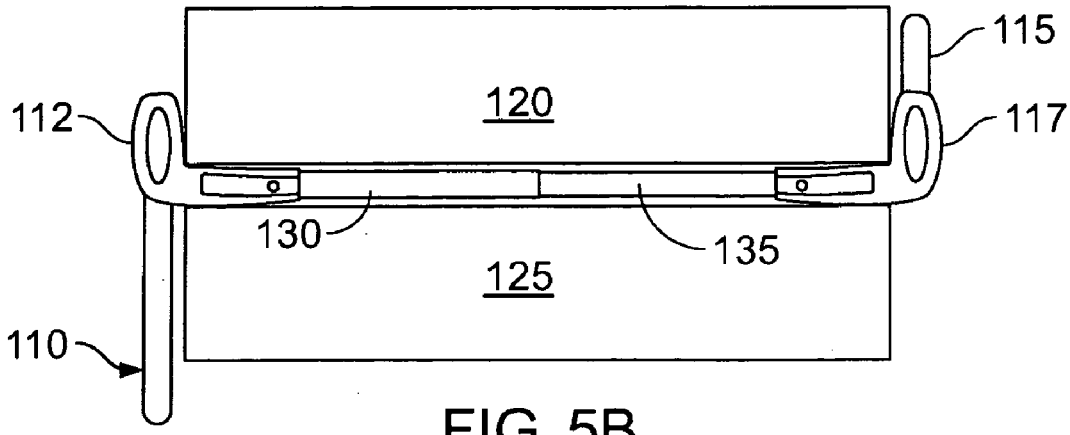
Figure 6A:
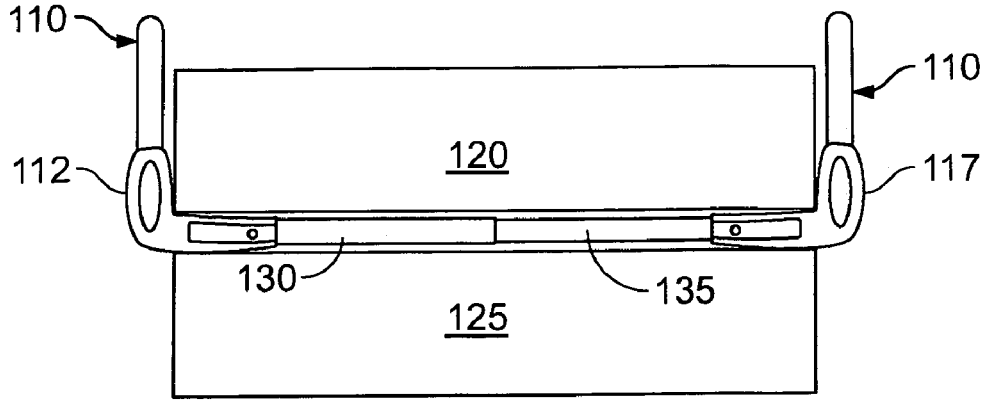
FIGS. 6A to 6C are side views of the bed rail of FIG. 3 in various configurational positions.
Figure 6B:
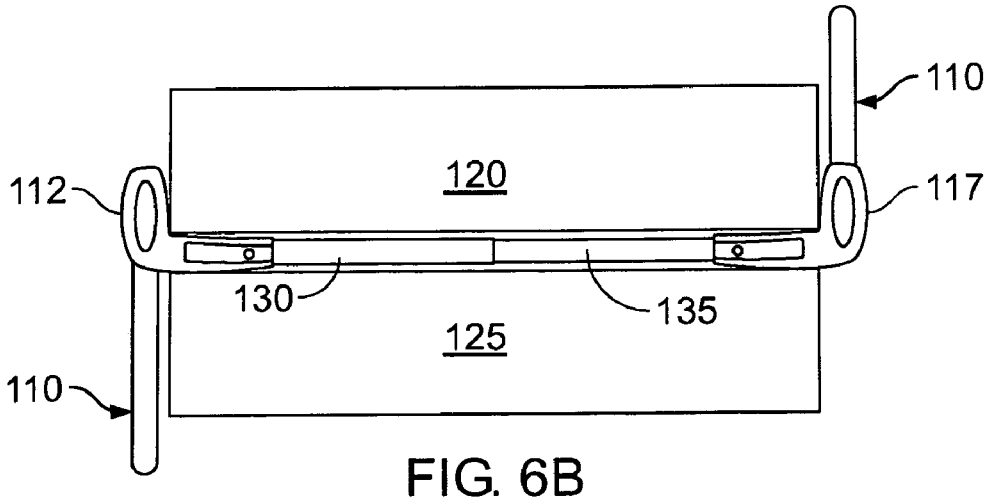
Figure 6C:
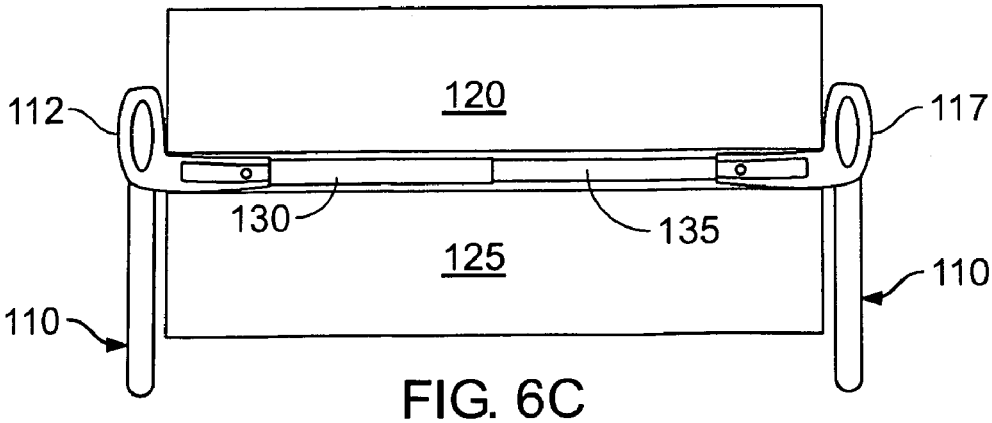

Referring now to FIGS. 5A and 5B, the side panel 110 of the bed rail 100 is positioned in an upright, deployed position in FIG. 5A and in a downward, undeployed position as shown in FIG. 5B. Referring now to FIGS. 6A–6C, the two side panels 110 of the bed rail 100 can be positioned in the following configurations. Both sides panels 110 are set in the upright deployed position in FIG. 6A. One side panel 110 is set in the upright position and one side panel is set in the downward position as shown in FIG. 6B. Both side panels 110 are set in the downward position as shown in FIG. 6C.

Figure 7:
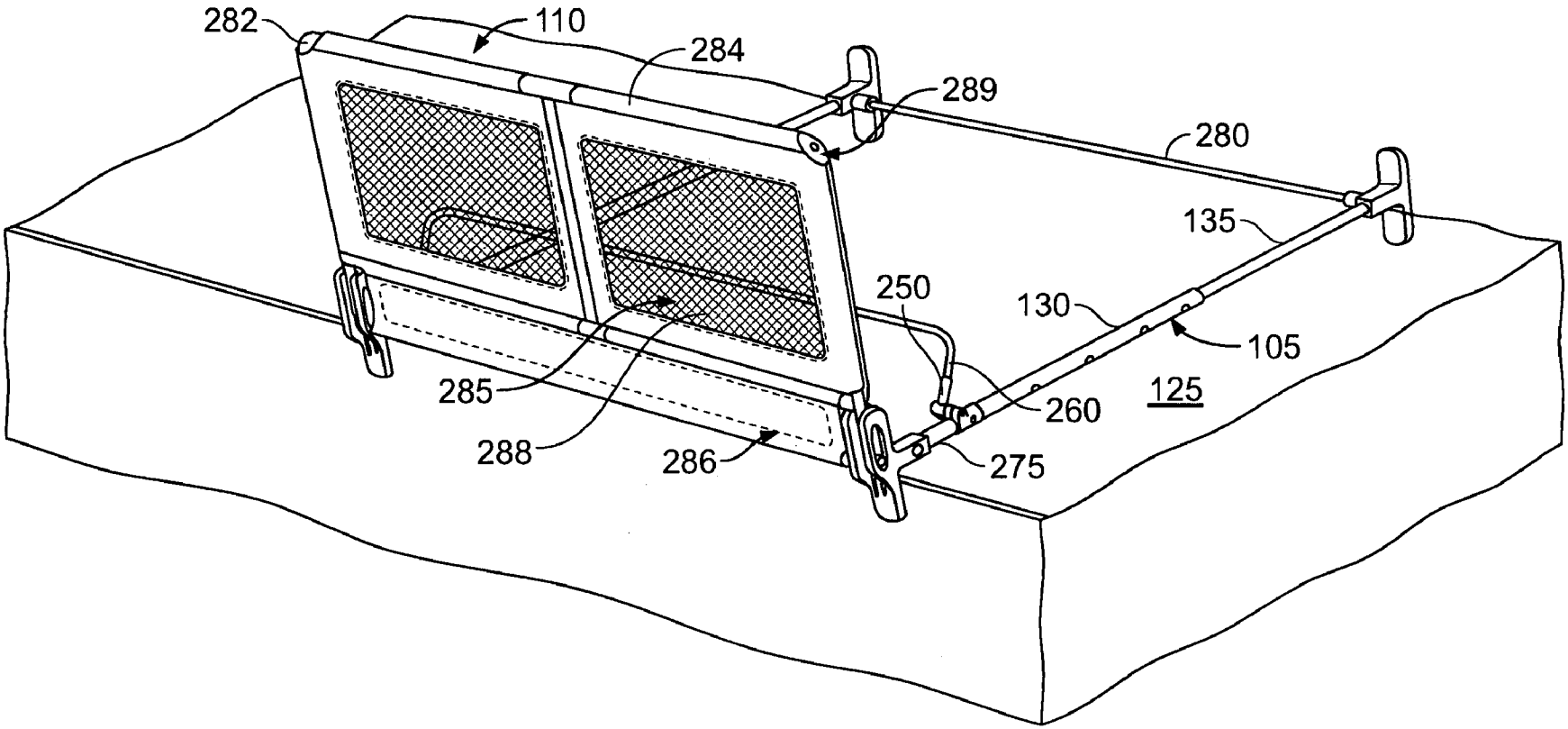
FIG. 7 is a perspective view of a bed rail according to another aspect of the invention, positioned on a portion of bed.
Figure 8:
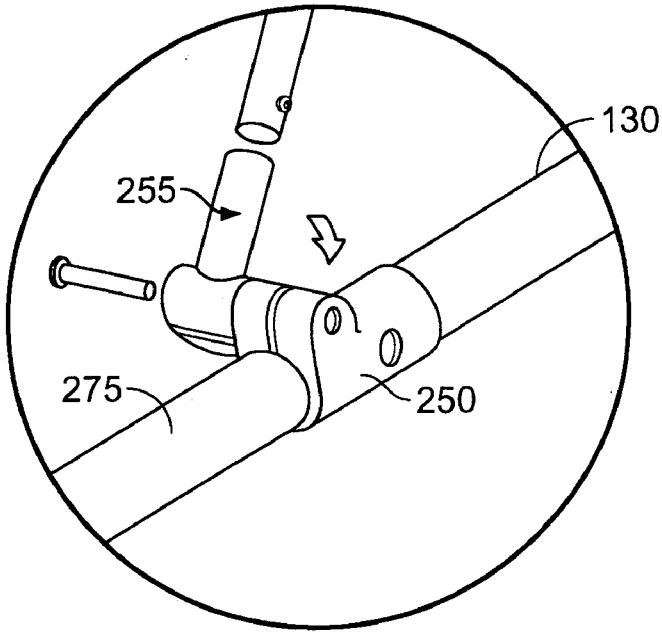
FIG. 8 is a detailed perspective view of a portion of the locking bar of the bed rail of FIG. 7.

Referring now to FIGS. 7 and 8, in an alternative embodiment, the transverse members 105 includes a pair of pinch clamps 250 having rotatable levers 255. A locking bar 260 is attached to the levers 255. In one embodiment, large adjustment of the transverse members 105 is made as described above, and including a first member 130 telescopically engaging a second member 135. The first member 130 of transverse members 105 includes a plurality of holes 140 sized to receive a spring pin 145, such as a Valco spring pin, disposed within the second member 135. In the embodiment shown, a third member 275 slidably engages the first member 130 for effecting fine adjustment of the transverse member 105.

With the locking bar 260 in an upright position, the pinch clamps 250 are disengaged and the third member 275 slides freely within the first member 130 for fine adjustment of the length of the transverse member 105. The mattress 120 will not lay flat upon the foundation 125 with the locking bar 260 in the upright position and this configuration provides a readily observable indication that the bed rail 100 is not locked.

With the locking bar 260 in a substantially horizontal and lowered position, the levers 255 rotate (one clamp is a right-hand thread and the other clamp is a left-hand thread) in opposite directions to tighten the pinch clamps 250, thereby locking the relative positions of the first member 130 and the third member 275 and maintaining the transverse members 105 at the desired length. With the locking bar 260 in the lower positioned, the mattress 120 can be properly positioned atop the foundation 125 and provide an indication of the locked status of the pinch clamps 250. For additional structural support, the bed rail 100 includes longitudinal supports 280, in one embodiment.

With continued reference to FIG. 7, the side panel 110 includes a tubular frame 282, supporting any suitable fabric covering 284. Advantageously and in one embodiment, a fabric mesh 285 is attached to an upper region of the side panels 110, and a perforated masonite panel 286 is attached to the lower region of the side panels 110. The fabric mesh 285 and masonite panels 286 are sewn in along the inner periphery of the fabric covering 284. In one embodiment, clear rigid panels 288 are sewn into the fabric mesh 285 to provide additional structural integrity to the side panels 110 without reducing visibility while in a supine position on the bed. In one embodiment, the rigid panels 288 are formed from polycarbonate plastic. Other materials having properties of sufficient resiliency and strength for retaining an infant within a bed may be attached to the tubular frame 282. For ease of assembly, the tubular frame 282 can include a number of supports and fittings for threading through the fabric covering 284. In this embodiment, one or more apertures 289 are provided in corners of the tubular frame 282 and other areas of the fabric covering 284 corresponding to the location of the junctures of the supports and fittings for ease of assembly.

Figure 9:
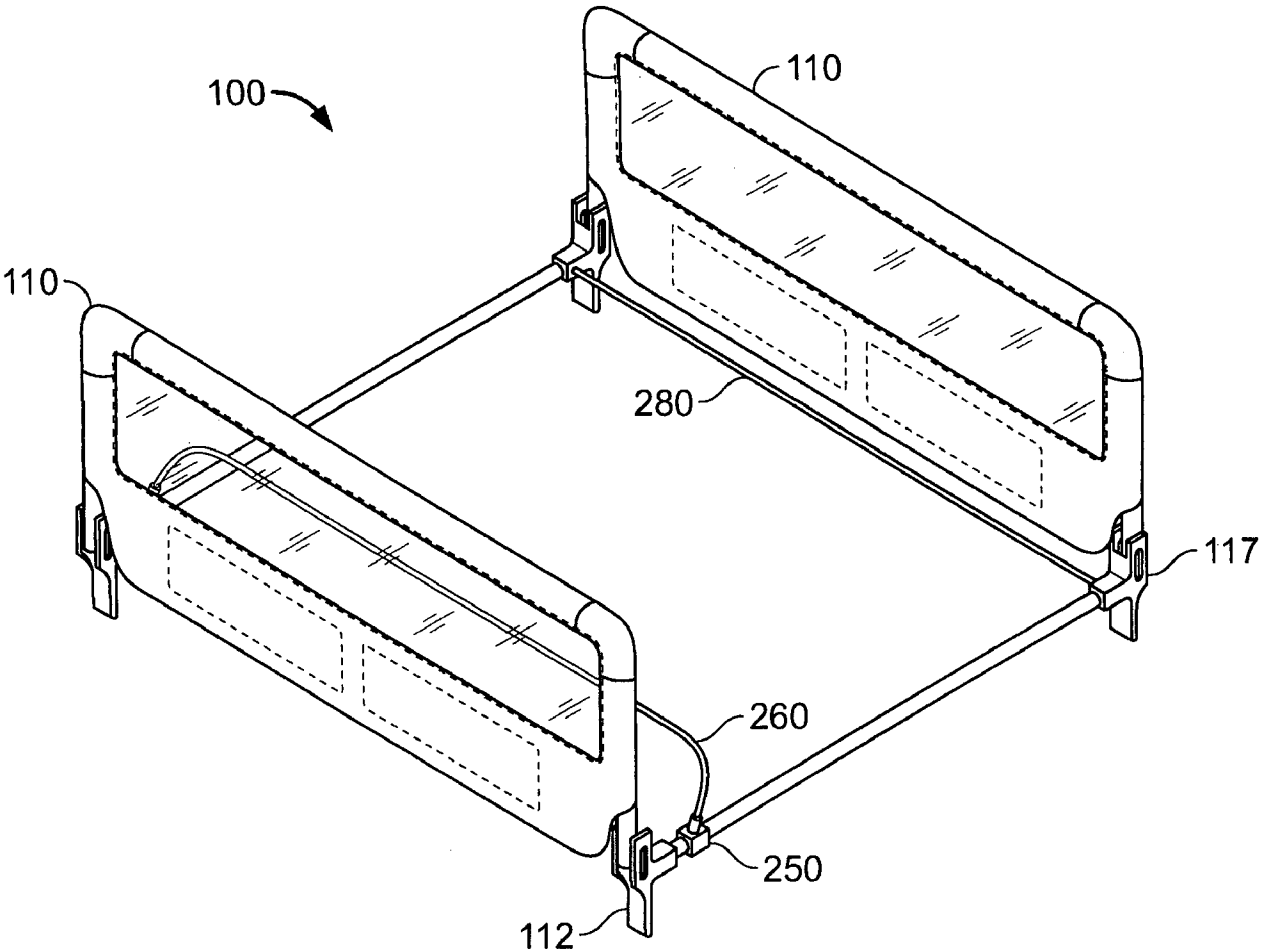
FIG. 9 is a perspective view of a bed rail according to another aspect of the invention with locking bar in the raised and unlocked position.
Figure 10:
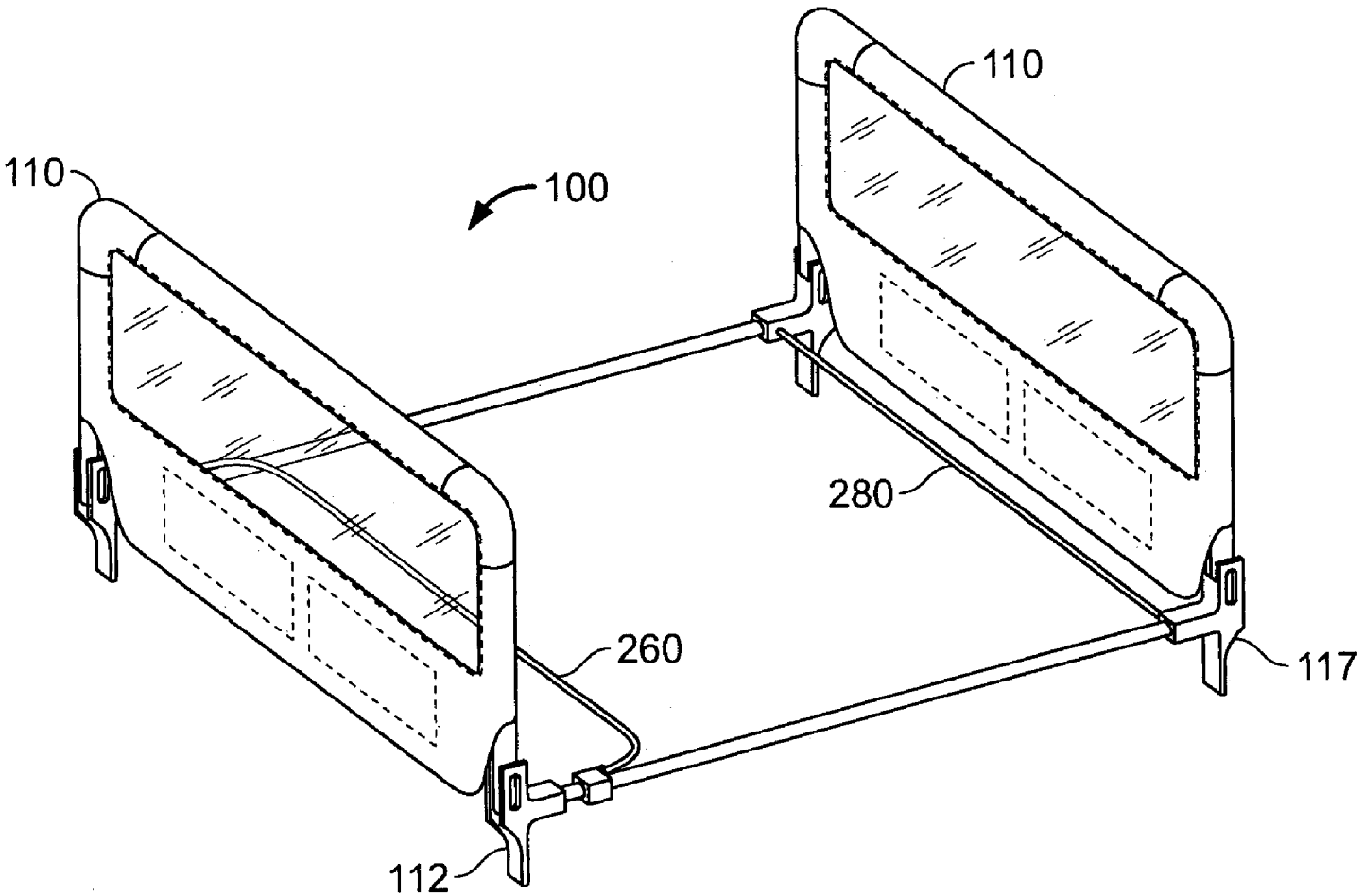
FIG. 10 is a perspective view of a bed rail according to another aspect of the invention with locking bar in the lowered and locked position.

In another embodiment, shown in FIGS. 9 and 10, the transverse members 105 do not include holes 140 and engaging Valco spring pins 145. Alternatively, the pinch clamps 250 provide the large adjustment of the length of the transverse members 105 by locking the relative positions of the first and second members 130, 135. In one embodiment, the fine adjustment is performed as described above in conjunction with FIGS. 4A–4B. The locking bar 260 is positioned in the upright and unlocked position in FIG. 9 and lowered into the locked and substantially horizontal position in FIG. 10. As described above, the mattress 120 will not lay flat atop the foundation 125 when the locking bar 260 is in the upright position. The upset mattress 120 provides an indication that the transverse member 105 is not locked and the bed rail 100 is not secured to the bed.

Figure 11:
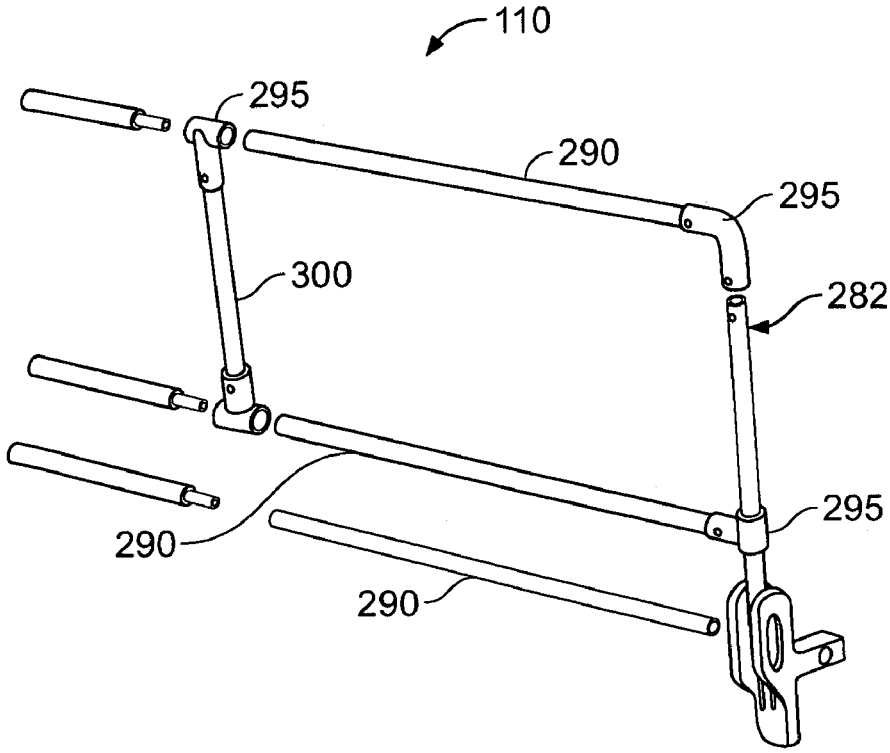
FIG. 11 is a partially exploded perspective view of a portion of a bed rail panel according to one embodiment.
Figure 12:
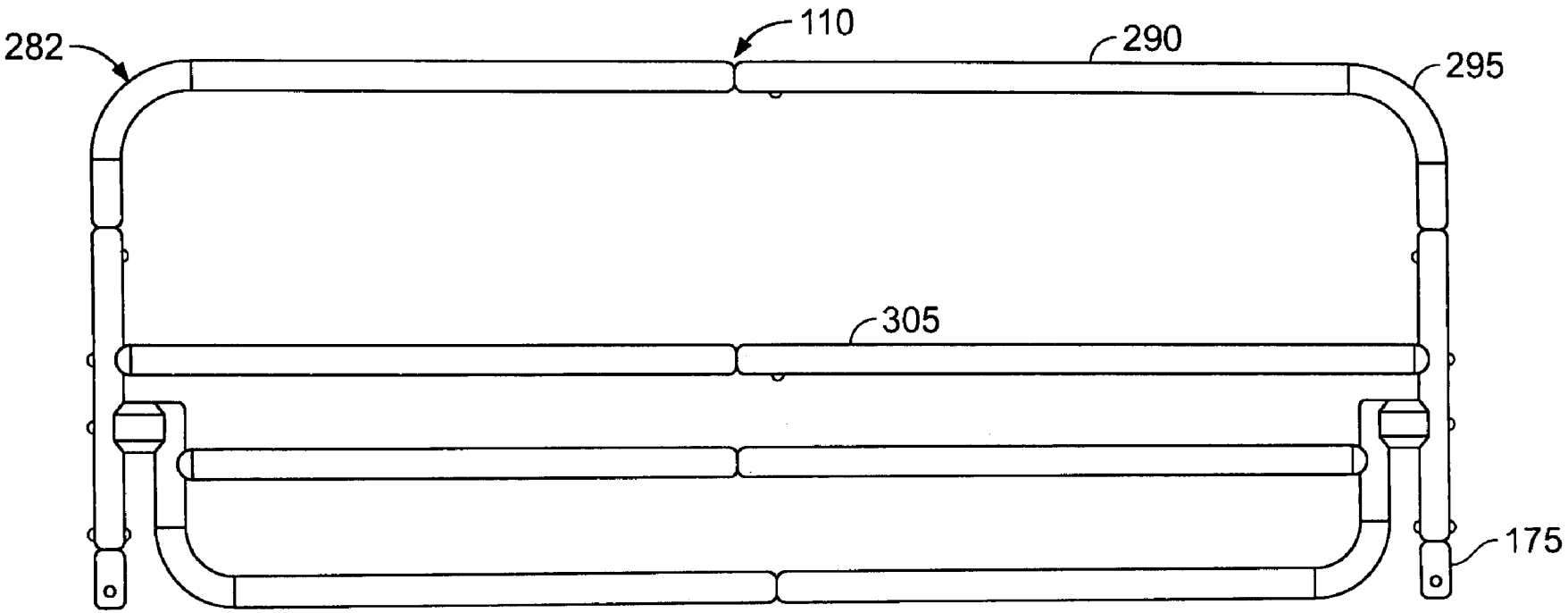
FIG. 12 is a front view of a bed rail panel according to one embodiment.

Referring now to FIGS. 11 and 12, embodiments of the side panel 110 includes a substantially rectangular tubular frame 282 having a plurality of supports 290 and fittings 295 for supporting the fabric covering 284 (FIG. 7). In one embodiment, the supports 290 and fittings 295 are pressure-fit together. In other embodiments, the supports 290 and fittings 295 are threaded together. In the embodiment shown in FIG. 11, the tubular frame 282 of the side panel 110 includes a center support 300 and in the embodiment shown in FIG. 12, the frame 282 includes a supplemental horizontal support 305. Other configurations of the tubular frame 282 for side panel 110 are contemplated by the invention.

A number of embodiments of the invention have been described. Nevertheless, it will be understood that various modifications may be made without departing from the spirit and scope of the invention. Accordingly, other embodiments are within the scope of the following claims.

What is claimed is:

1. A safety bed rail for preventing an individual from falling out of a bed, the bed rail comprising:

a frame of sufficient width to span a width of the bed and comprising left and right portions adjustably connected to define a plurality of discrete frame widths substantially corresponding to standard bed sizes;

a first bed rail panel attached to one side of the frame and extending up from the frame a sufficient height to extend above a mattress placed over the frame; and side flanges adjustably connected to the frame to further reduce the width of the frame over a limited distance to engage sides of one of the mattress and an underlying mattress support of similar width to the mattress with the frame disposed between the mattress and the support;

wherein bed rail panel comprises a tubular frame supporting a fabric covering, and wherein the tubular frame comprises substantially clear panels sewn into a fabric mesh attached to the fabric covering along an upper portion and a sewn in perforated masonite panel along a lower portion.

2. The bed rail of claim 1 wherein the frame comprises elongate transverse members for spanning the width of the bed comprising two telescoping members for adjusting the length thereof.

3. The bed rail of claim 1 wherein the bed rail panel is pivotally attached to one side of the frame and locateable in an upright deployed position and a lowered undeployed position.

4. The bed rail of claim 3 wherein a retention member is attached to another side of the frame opposite the bed rail panel.

5. The bed rail of claim 1 wherein a second bed rail panel is attached to another side of the frame opposite the first bed rail panel.

6. The bed rail of claim 5 wherein the bed rail panels are removable from the frame.

7. The bed rail of claim 1 wherein the left and right portions of the frame are adjustably connected by a releasable latch.

8. A safety bed rail for preventing an individual from falling out of a bed, the bed rail comprising:

a frame comprising cross-members of sufficient width to span a width of the bed;

a first bed rail panel attached to one side of the frame and extending up from the frame a sufficient height to extend above a mattress placed over the frame;

wherein the frame comprises side flanges extending downward from the cross-members on either side of the frame, to engage sides of an underlying mattress support, with the frame disposed between the mattress and the support, so as to substantially inhibit lateral movement of the frame with respect to the mattress support; and wherein the side flanges are rotatably coupled to the frame and wherein rotation of the flanges adjusts the width of the frame over a limited distance.

9. The safety bed rail of claim 8 further comprising left and right portions adjustably connected by a releasable latch defining a plurality of discrete frame widths corresponding to standard bed sizes.

10. The safety bed rail of claim 8 wherein the cross-members are substantially rigid.

11. The bed rail of claim 8 further comprising an adjustable clamp connecting left and right portions of the frame having at least one activating lever extending therefrom.

12. The bed rail of claim 11 further comprising a locking bar rotatably attached to the adjustable clamps at the activating levers wherein the locking bar is positionable in an upright position wherein the adjustable clamps are unlocked and a lowered position wherein the adjustable clamps are unlocked.

13. The bed rail of claim 12 wherein the mattress visibly separates from the foundation when the lockable bar is in the upright position.

14. The bed rail of claim 8 wherein the side flanges are widthwise adjustable to adjust the width of the frame over a limited distance.

15. The bed rail of claim 14 wherein the first bed rail panel is removably attached to the one side of the frame.

16. The bed rail of claim 12 wherein a second bed rail panel is attached to another side of the frame opposite the first bed rail panel.

17. The bed rail of claim 12 wherein the frame comprises elongate transverse members comprising two telescoping members for adjusting the length thereof.

18. The bed rail of claim 17 wherein the transverse members include a spring bias for expanding the two telescoping members in an outward direction when the locking bar is in the upright position.

19. A safety bed rail for preventing an individual from falling out of a bed, the bed rail comprising:

a frame of sufficient width to span a width of the bed and comprising left and right portions adjustably connected to define a plurality of discrete frame widths substantially corresponding to standard bed sizes;

a first bed rail panel attached to one side of the frame and extending up from the frame a sufficient height to extend above a mattress placed over the frame; and side flanges adjustably connected to the frame to further reduce the width of the frame over a limited distance to engage sides of one of the mattress and an underlying mattress support of similar width to the mattress with the frame disposed between the mattress and the support; and wherein rotation of the flanges adjusts the width of the frame over a limited distance with a latch connecting the left and right frame portions in a selected position.

* * * * *